US006079823A

United States Patent [19]

Droege

[11] Patent Number: 6,079,823

[45] Date of Patent: Jun. 27, 2000

[54] INK BOTTLE WITH PUNCTURABLE DIAPHRAGM CLOSURE

[75] Inventor: Curtis R. Droege, County of St. Clair, Ill.

[73] Assignee: Marconi Data Systems Inc., Wood Dale, Ill.

[21] Appl. No.: 08/898,802

[22] Filed: Jul. 23, 1997

[51] Int. Cl.[7] ..... B41J 3/175

[52] U.S. Cl. ..... 347/85

[58] Field of Search ..... 347/85, 86, 87; 106/20 C; 215/247

[56] References Cited

U.S. PATENT DOCUMENTS

| | | | |
|---|---|---|---|
| 4,183,031 | 1/1980 | Kyser et al. | 347/86 |
| 4,383,263 | 5/1983 | Ozawa et al. . | |
| 4,419,678 | 12/1983 | Kasugayama et al. . | |
| 4,531,656 | 7/1985 | Nitchman et al. | 222/131 |
| 4,678,101 | 7/1987 | Nitchman et al. | 222/82 |
| 4,699,188 | 10/1987 | Baker et al. . | |
| 4,831,389 | 5/1989 | Chan | 347/86 |
| 5,343,226 | 8/1994 | Niedermeyeyr et al. | 347/85 |
| 5,433,330 | 7/1995 | Yatsko et al. | 215/247 |
| 5,679,138 | 10/1997 | Bishop et al. | 106/20 C |
| 5,815,182 | 9/1998 | Otis et al. | 347/86 |

FOREIGN PATENT DOCUMENTS

| | | | |
|---|---|---|---|
| 0 117 718 | 9/1984 | European Pat. Off. . | |
| 0 322 131 | 6/1989 | European Pat. Off. . | |
| 0 523 915 A2 | 1/1993 | European Pat. Off. . | |
| 0 676 293 | 10/1995 | European Pat. Off. . | |
| 0 778 148 A1 | 6/1997 | European Pat. Off. . | |
| 2 300 834 | 11/1996 | Germany . | |
| 405096744 | 4/1993 | Japan | 347/86 |
| 09 109414 | 4/1997 | Japan . | |
| WO 83 00932 | 3/1983 | WIPO . | |
| WO 93 18920 | 9/1993 | WIPO . | |

*Primary Examiner*—N. Le
*Assistant Examiner*—Anh T. N. Vo
*Attorney, Agent, or Firm*—Polster, Lieder, Woodruff & Lucchesi, L.C.

[57] ABSTRACT

This invention relates to a replaceable ink container or bottle (1) for an ink jet printing apparatus in which the mouth of the bottled is closed by a puncturable diaphragm (19). A puncturing member (35) carried by the ink reservoir (21) of the ink jet printing apparatus pierces through the diaphragm upon the container being installed in the ink jet printing apparatus. Upon the puncturing member (35) puncturing through the diaphragm (19), the diaphragm sealingly engages the sides of the puncturing tube so as to substantially prevent the ink from leaking therepast, and the puncturing tube opens communication between the ink within the container and the ink reservoir thereby permitting ink to flow from the bottle into the ink reservoir via the puncturing member. An air path (37) is provided which is in communication with the atmosphere and with the reservoir so that ink from within the container and atmospheric air may be exchanged via the puncturing member so that ink is free to flow from the container into the reservoir, and so that the pressure within the container is maintained substantially at atmospheric pressure. A method of supplying ink to such an ink jet printing apparatus also is disclosed.

18 Claims, 3 Drawing Sheets

INK BOTTLE WITH PUNCTURABLE DIAPHRAGM CLOSURE

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE INVENTION

This invention relates to an ink bottle (or other container) for containing a supply of ink for an ink jet printing system. The ink jet printing apparatus for which the ink bottle of the present invention is intended for use is generally referred to as an industrial type ink jet printing system (as opposed to an office ink jet printer) which typically is used to print indicia on packaging or on secondary packaging of products conveyed past the ink jet printhead of this system as the products in their packages are conveyed past the printhead on a conveyor belt or the like. Such ink jet printing systems are shown in the co-pending U.S. patent application Ser. No. 08/728,774 filed Oct. 11, 1996, assigned to Marsh Company of Belleville, Ill., the assignee of the instant patent application. The above-noted co-assigned patent application is herein incorporated by reference. It will be appreciated that such industrial ink jet printing systems typically use considerably more ink in a given time than office ink jet printers because the area printed by such industrial printers is greater and the industrial printing systems operate continuously. Thus, it is desirable to provide a relatively large supply of ink for such industrial ink jet printers, as compared to office ink jet printers.

Heretofore, ink was supplied to such commercial ink jet printing systems by means of a disposable ink bottle holding a desired quantity of ink (e.g., a pint or a liter). One such ink bottle is shown in U.S. Pat. No. 5,343,226 entitled "Ink Jet Ink Supply Apparatus," which has a spring biased poppet valve incorporated in a screw on cap such that when the bottle is inverted and threaded into a receptacle in the ink jet printing apparatus, a finger will engage the normally closed spring biased valve in the cap, and will force the valve to open, thus allowing ink from within the bottle to fill a reservoir of the ink jet printing apparatus. Upon removal of the ink bottle from the ink jet printing apparatus, the valve will close under the bias of the spring, and thus the valve will prevent the flow of ink from the bottle as it is removed. While such bottles worked well for their intended purpose, the necessity of including the spring biased valve in the cap of each bottle is expensive.

Reference also may be made to U.S. Pat. Nos. 4,531,656 and 4,678,101 which disclose the use of a puncturable closure for a bottle from which a liquid is to be pressure dispensed.

BRIEF SUMMARY OF THE INVENTION

Among the several objects and features of the present invention, it will be noted the provision of a container or a bottle for holding a supply of ink for an ink jet printing apparatus in which the mouth of the bottle is closed by a puncturable diaphragm sealed with respect to the mouth of the bottle such that upon installation of the bottle in an inverted position within the ink jet printing apparatus, a hollow piercing member will pierce through the diaphragm and open communication with the ink inside the bottle, thus allowing the ink to flow by gravity through a piercing member into a reservoir of the ink jet printing system, and such that atmospheric air may enter the bottle through the piercing member to replace the ink as it flows from the bottle into the ink jet printing apparatus;

The provision of such a container or bottle in which the diaphragm has a pre-formed, but still sealed, area (line) of weakness therein which is broken open upon the piercing member being inserted therethrough with the edges of such area of weakness being at least in part in sealing engagement with the sides of the piercing member so as to substantially prevent undesired leakage of the ink;

The provision of such a container in which the diaphragm is of elastomer sheet material having sufficient resiliency and memory such that as the piercing member is withdrawn from the diaphragm, the opening formed by the piercing member will close, thus effectively re-closing (and in some instance re-sealing) the opening and preventing leakage of the ink;

The provision of such a container in which the material from which the diaphragm is made has a surface energy relative to the surface tension of the ink such that upon re-closing of the line of weakness or slit in the diaphragm, the ink will bridge across the slit such that leakage of the ink through the slit is substantially prevented; and The provision of such a container which is of simple and economical construction, which may be readily filled with ink, which may be readily sealed with such diaphragm, which is easy to use, and which requires little in the way of special instructions for use, and which is of economical and rugged construction.

Briefly stated, this invention is intended for use with an ink jet printing apparatus having an ink reservoir for receiving a supply of ink from a replaceable ink container, the latter having a mouth and a supply of ink within the container, the ink reservoir having an ink well for containing a supply of ink. Specifically, the improvement of this invention comprises a resilient, puncturable diaphragm closing the mouth of the container. A puncturing member is carried by the ink reservoir of the ink jet printing apparatus. The puncturing member is engageable with the diaphragm upon the container being inverted such that the diaphragm faces downwardly as the container and the diaphragm are moved downwardly on the puncturing member so that the puncturing member pierces through the diaphragm. Upon the puncturing member puncturing through the diaphragm, the latter sealingly engages the sides of the puncturing tube so as to substantially prevent the ink from leaking therepast. The puncturing member opens communication between the ink within the container and the ink reservoir thereby, permitting ink to flow from the bottle into the ink reservoir via the puncturing member. An air path is provided which is in communication with the atmosphere and with the reservoir so that ink from within the container and atmospheric air may be exchanged via the puncturing member so that ink is free to flow from the container into the reservoir and so that the pressure within the container is maintained substantially at atmospheric pressure.

This invention further relates to a method of supplying ink to an ink jet printing system, the latter having a closed ink reservoir, a generally vertical puncturing tube extending above the reservoir and providing communication to the interior of the reservoir with the puncturing tube extending downwardly within the reservoir to a predetermined level, an air passageway extending from the atmosphere exteriorly of the reservoir to the reservoir, an ink bottle having a flexible puncturing diaphragm, wherein the method comprises the steps of inverting the ink bottle such that the diaphragm faces the puncturing tube and causing the puncturing tube to pierce through the diaphragm, thereby opening communication between the interior of the ink bottle and the reservoir. The method further involves sealing the puncturing tube relative to the diaphragm. Still further, the method allows the exchange of ink from the bottle into the reservoir and of atmospheric air into the bottle as the ink flows therefrom via the puncturing tube.

Other objects and features of this invention will be in part apparent and in part pointed out hereinafter.

BRIEF DESCRIPTION OF THE SEVERAL VIEWS OF THE DRAWINGS

Corresponding reference characters indicate corresponding parts throughout the several view of the drawings.

DETAILED DESCRIPTION OF THE INVENTION

Figure 1:
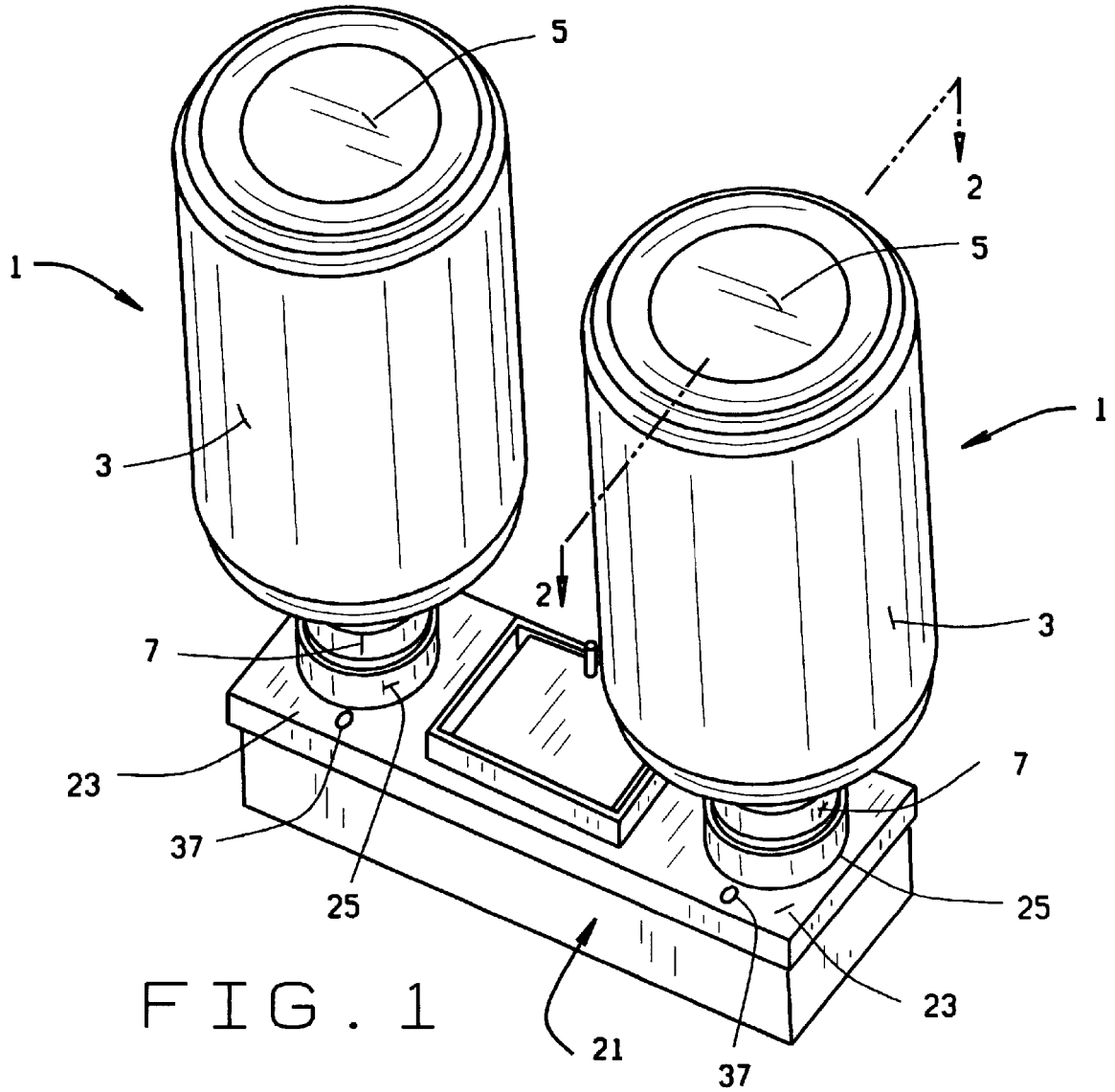
FIG. 1 is a top perspective view of an ink reservoir of a commercial ink jet printing apparatus having two (2) disposable ink bottles of the present invention installed in the ink reservoir so as to supply ink thereto.

Referring now to the drawings, an ink supply system for an ink jet printing apparatus is shown in which an ink bottle or container 1 of the present invention supplies ink to the printhead of the ink jet printing apparatus, such as is disclosed in the co-assigned U.S. patent application Ser. No. 08/728,774, which application is herein incorporated by reference. For the sake of brevity, only the ink bottle 1 and such structure from the ink jet printing apparatus as is needed to interface with and to receive the ink from the bottle 1 are herein described.

Figure 2:
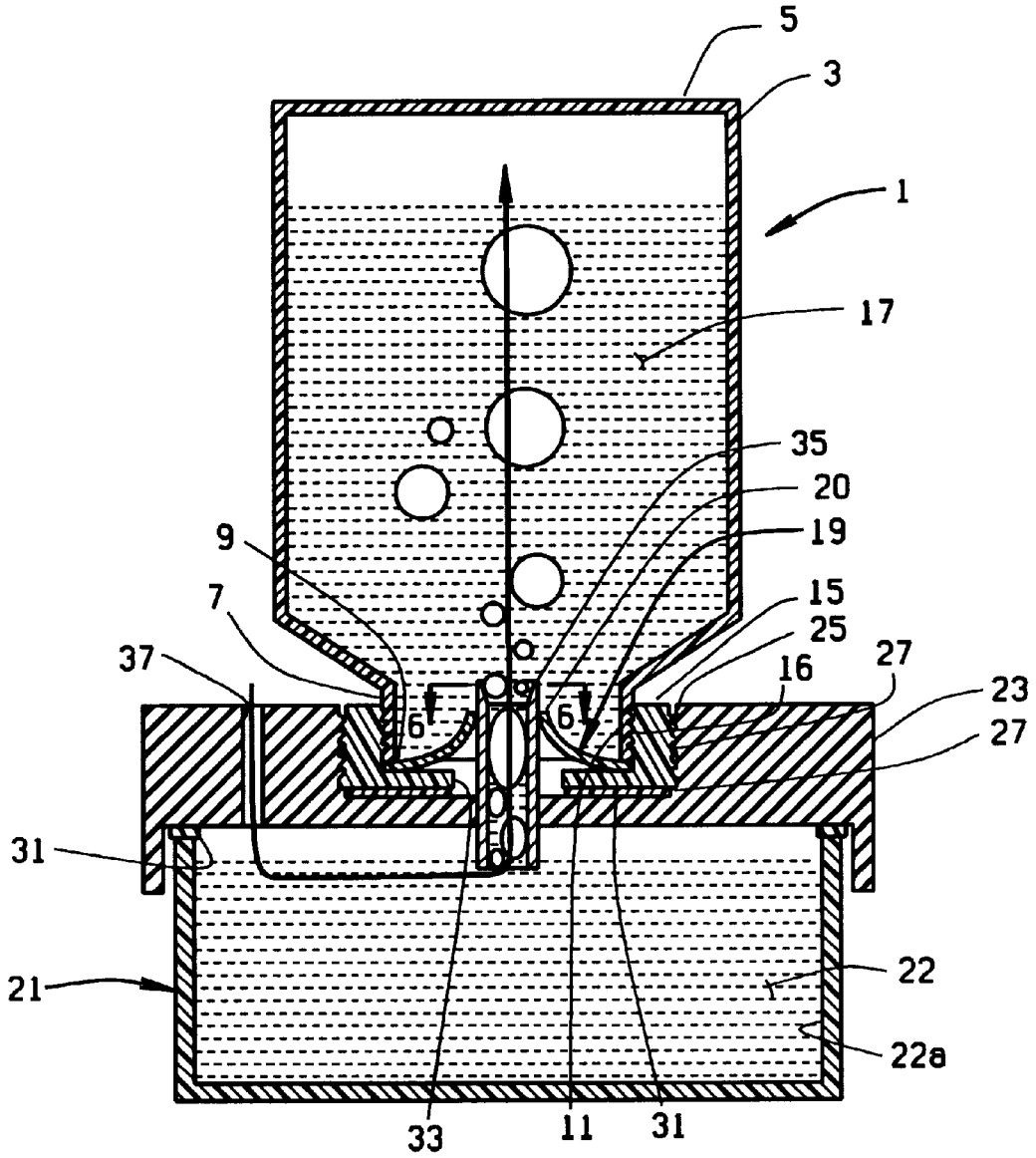
FIG. 2 is vertical cross sectional view of one of the ink bottles (containers) of FIG. 1 containing ink in its inverted, installed position as it is installed in the ink reservoir, illustrating a supply of ink within the container, and further illustrating a puncturing member which has pierced through a flexible, elastomeric diaphragm closing the mouth of the container, and further illustrating the manner in which atmospheric air may be vented into the container upon the level of the ink within the reservoir failing below a predetermined level such that the air and ink are exchanged in the bottle via the puncturing member.
Figure 6:
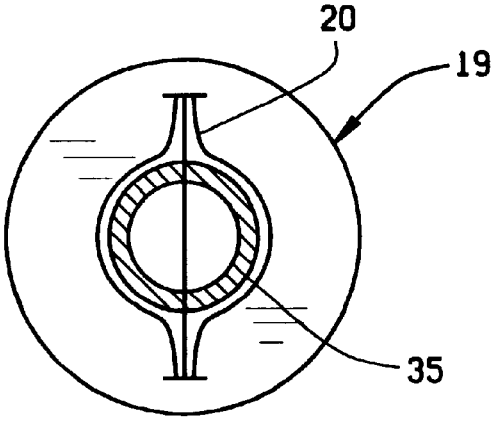
FIG. 6 is a cross-section taken along line 6—6 of FIG. 2 illustrating the piercing tube or septum passing through the slit in the diaphragm.
Figure 7:
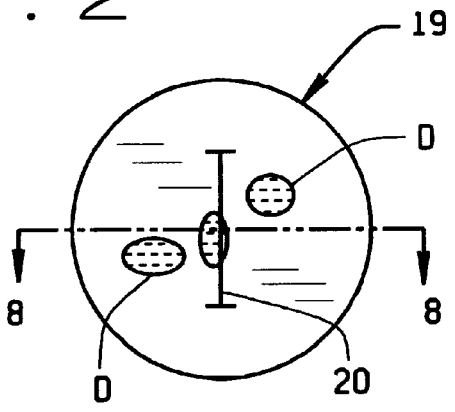
FIG. 7 is a plan view of the diaphragm showing drops of ink thereon.

As shown in FIG. 2, ink bottle 1 is in an inverted position when it is installed in the ink jet printing apparatus. Bottle 1 has a bottle body 3 having a closed bottom 5, a neck 7, and a mouth 9. The neck 7 of the bottle 1 has suitable external screw threads 11 (see FIG. 5) formed on the outer surface thereof and a suitable over cap 15 having internal threads 16 (see FIG. 5) is threaded onto threads 11 on neck 7 of bottle 1. As shown in FIG. 2, bottle 1 contains a supply of ink 17. Preferably, bottle 1 is a semi-rigid bottle blow molded of a suitable synthetic resin, such as a suitable high density polyethylene (HDPE) or the like, which is compatible with ink 17 contained within the bottle. Of course, those skilled in the art will recognize that the bottle 1 should have sufficient barrier properties and the like so as to insure an adequate shelf life for the ink.

Figure 5:
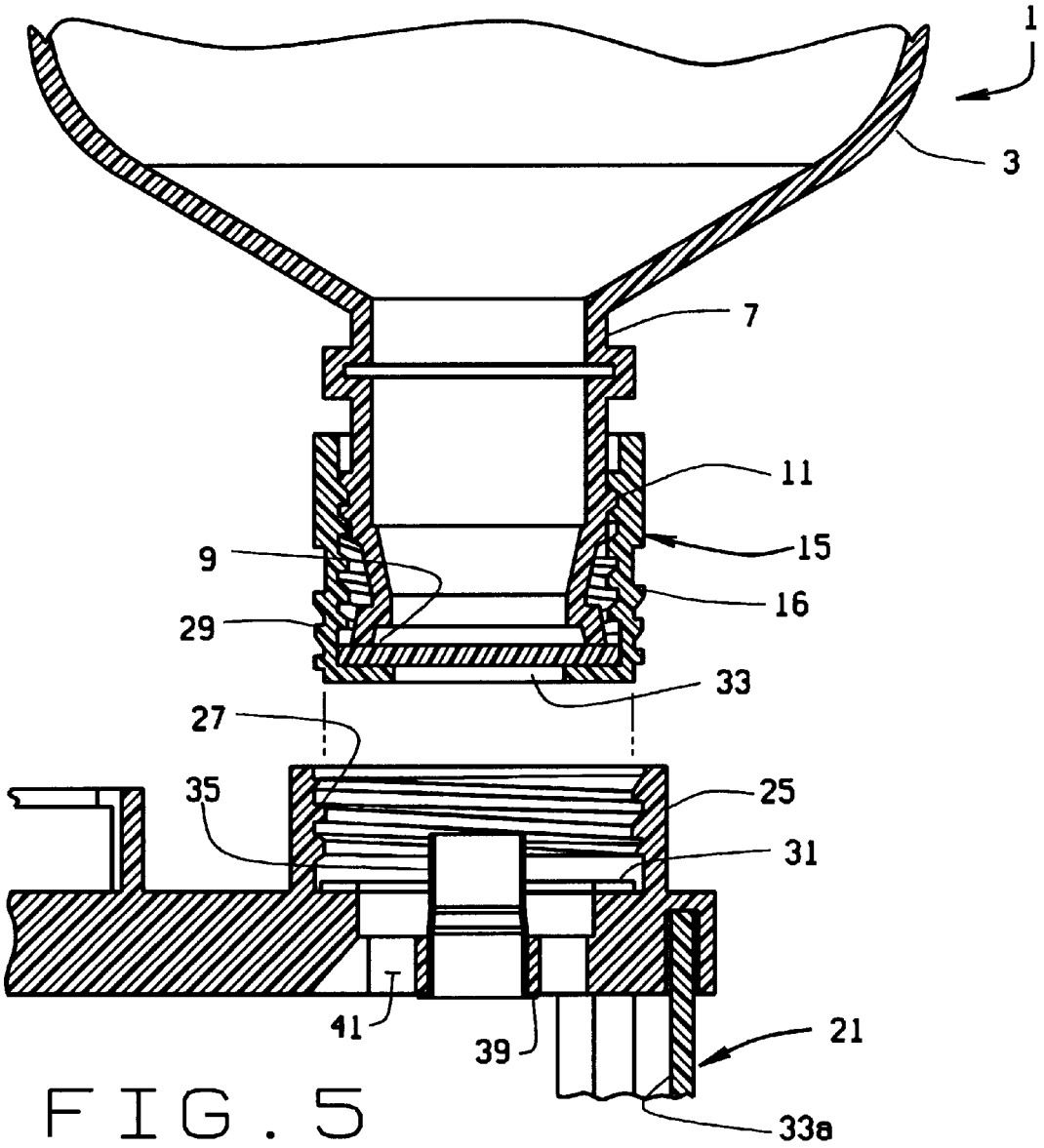
FIG. 5 is an enlarged exploded view of a portion of the ink bottle and of the ink reservoir, illustrating the installation of the ink bottle into a threaded socket in the ink reservoir and further illustrating a piercing member for piercing through the puncturable membrane in the cap of the ink bottle so as to open communication between the ink within the bottle.

In accordance with this invention, a resilient, elastomeric diaphragm or membrane 19 covering the open mouth of the bottle 1 is sealably secured to the mouth 9 of the bottle so as to seal the ink within the bottle. Preferably, diaphragm 19 is of a suitable elastomeric sheet material, such as natural rubber or sheet silicone material. However, other materials, such as low density polyethylene (LDPE), may be used. The elastomeric material from which diaphragm 19 is formed preferably has sufficient memory that after being deformed, the diaphragm will quickly and resiliently return to its flat position, as shown in FIG. 2. As shown in FIGS. 2 and 5, diaphragm 19 is interposed between the underside of cap 15 and the edge of bottle mouth 9 such that when the cap is tightly screwed in place on the neck of the bottle, the diaphragm will be tightly gripped between the bottle mouth and the cap, thereby sealing it therebetween. The diaphragm also may be sealing secured by the mouth of the bottle as by ultrasonically welding or the like.

Figure 3:
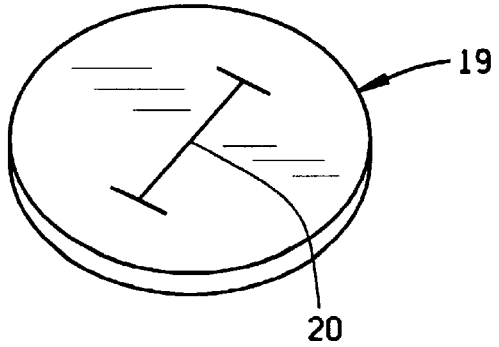
FIG. 3 is a perspective view of the elastomeric diaphragm or membrane closing the mouth of the bottle having a pre-formed partial slit (i.e., an area of weakness) therein.

As shown in FIG. 3, elastomeric diaphragm 19 may have an optional, pre-formed slit 20 therein. Slit 20 is preferably not fully through the thickness of the diaphragm, but instead is a line (area) of weakness which will open or tear upon installation of bottle 1 in the ink jet printing apparatus as will be more fully described hereinafter. However, within the broader aspects of this invention, slit 20 is not required, as the piercing member, as will be hereinafter described, may puncture the diaphragm without the pre-formed area of weakness. Further, while slit 20 is shown to be a single slit, multiple star shaped or pie slice shaped slits (or other area of weakness) also may be used.

As further shown in FIG. 2, an ink reservoir of the ink jet printing apparatus, as indicated generally at 21, has an ink well 22*a* which holds a supply 22 of ink dispensed from bottle 1 for use by the ink jet printing apparatus. Ink from reservoir 21 is conveyed to the printhead (not shown) of the ink jet printing apparatus so as to print desired indicia on objects in the manner well known to those skilled in the art. For the sake of simplicity and brevity, the ink supply tube from reservoir 21 to the printhead is not shown. Reservoir 21 has a reservoir lid 23 enclosing the ink within the reservoir.

Figure 4:
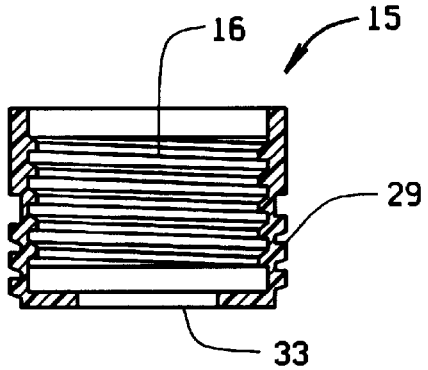
FIG. 4 is a cross sectional view of a cap to be threadably installed on the threaded neck of the ink bottle with the cap having external threads formed thereon for threadably engaging internal female threads within a socket in the ink reservoir.

Reservoir lid 23 has two recesses or sockets 25 formed in the upper portion thereof for receiving the cap 15 of a respective bottle 1. Preferably, each recess 25 has female threads 27 (see FIGS. 2 and 5) on its vertical sides and cap 15 has mating male threads 29 on its outer sides engageable with female threads 27. A gasket 31 having a center opening 32 (see FIG. 5) is interposed between the cap 15 and the base of recess 25 so that upon screwing cap 15 into recess 25, the cap will sealingly engage gasket 31 and seal the cap to the reservoir lid 23. Preferably cap 15, in addition to being screwed onto the bottle neck 7, is adhesively bonded (or otherwise secured) to the bottle such that the cap will not unscrew. As shown in FIGS. 2, 4 and 5, cap 15 has a center opening 33 which exposes a portion of diaphragm 19 through gasket 31.

Reservoir lid 23 has a puncturing or piercing member or septum 35 fixed with respect to the reservoir lid 23 and extending upwardly within center of recess 25. Preferably, puncturing member 35 is a hollow, tubular member which, as will be herein described in detail, allows air and ink exchange therethrough. The diameter of piercing tube 35 is sized relative to the density and viscosity of the ink and relative to the resilient and elastomeric properties of the diaphragm 19 such that the piercing tube will readily pierce the diaphragm and leak past the diaphragm will be minimized.

As shown in FIG. 5, piercing tube 35 is supported by an open spider structure 39 having one or more passages 41 extending from the area below gasket 31 downwardly into reservoir 21. In this manner, any ink that seeps or leaks between slit 20 of diaphragm 19 and piercing tube 35 drains into the reservoir and is not wasted.

By way of example, a typical ink used for ink jet printing may have a surface tension of about 35 dyne/cm. and a viscosity as high as about 350 centipoise. Diaphragm 19 may be of sheet silicone elastomer commercially available from SFS Industries of Santa Fe Springs, Calif. having a thickness of 3/32 inches and a Shore hardness of about 70 A. The diameter of the mouth 9 of bottle 1 is about 1.48 inches and the length of pre-formed slit 20 in diaphragm 19 is about 0.8 inches. Piercing tube 35 is a length of stainless steel tubing having an outer diameter of about 0.375 inches.

The above example illustrates one size bottle and diaphragm thickness. It will be understood by those skilled in the art that the material from which the membrane is made, the diameter of the piercing member, the diameter of the mouth of the bottle, and other factors may vary widely in accordance with this invention.

Figure 8:
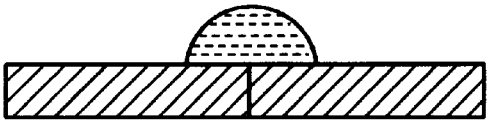
FIG. 8 is a cross-section taken along line 8—8 of FIG. 7 showing a preferred construction of the diaphragm wherein the surface energy of the diaphragm is less than the surface tension of the ink such that a drop of ink on the surface of the diaphragm and opening of the re-closed slit will not wick through the slit.
Figure 9:
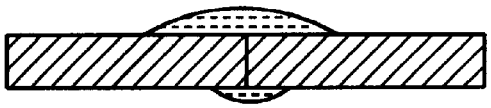
FIG. 9 is a view similar to FIG. 8, but where the surface energy of the diaphragm is somewhat greater than the surface tension of the ink such that at least some of the ink such that at least some of the ink is drawn by capillary action (wicks) through the re-closed slit.

In addition to the above noted physical properties of diaphragm 19, it is preferred that diaphragm 19 have a surface energy less than the surface tension of ink 17 such that droplets D of ink (as shown in FIG. 8) will bead up on the surface of diaphragm 19 and will bridge a re-closed slit 20 such that ink will not wick through the slit by capillary action. Thus, upon removal of a partially filled bottle 3 from piercing tube 35, the resilient nature of the diaphragm will cause slit 20 to re-close and the lower surface energy of the diaphragm material will prevent loss of ink. For example, for the above-noted ink having a surface tension of about 35 dyne/cm., the elastomeric material of diaphragm 19 should have a lower surface energy of about 20 dyne/cm. to yield the ink beading as shown in FIG. 8. The surface energy is greater than the surface tension of the ink, the ink droplet D', as shown in FIG. 9, will not bridge re-closed slit 20 and will wick through or leak through the slit.

By the way of example, the filled ink bottle 1 is inverted such that its cap 15 faces downwardly. The cap 15 is inserted into socket 25 and the male threads 29 on the outer surface of the cap 15 are threaded into female threads 27 in socket 25. As the cap 15 is threaded downwardly into the recess 25, the upper end of piercing member 35 engages the pre-formed area of weakness (slit 20) and punctures through the membrane 19 along the pre-formed slit (or line of weakness) 20. As the piercing member 35 punctures through the membrane 19, the membrane 19 resiliently grips the outer surface of the piercing member 35 and seals the outer surface of the piercing member 35 relative to the membrane 19 thereby to substantially prevent ink from leaking from the interface of the piercing member 35 and the membrane 19. Of course, once communication is opened between the interior of bottle 1 and ink reservoir 21, ink will flow from the bottle 1 into the reservoir 21.

Further, as shown in FIG. 2, reservoir lid 23 has an air path 37 therethrough which allows atmospheric air to enter reservoir 21 and to permit the exchange of air and ink within bottle 1 via piercing tube 35 as ink flows from the bottle, into ink reservoir 21. As shown in FIG. 2, the level of the ink 22 in reservoir 21 is at the level of the lower end of the piercing tube 35. Upon the ink level in the reservoir 21 falling below the lower end of the piercing tube 35, air from air path 37 is free to enter the piercing tube 35 and to bubble up through the tube 35 into the interior of the ink bottle 1 thus allowing the ink within bottle 1 to flow downwardly through the piercing tube 35 into the ink reservoir 21 and to replace the ink 17 drained from the bottle 1. In this manner, atmospheric pressure is maintained within the bottle 1 and the ink 17 is free to flow from the bottle 1 so as to maintain a desired quantity of ink 22 in reservoir 21.

If it is desired to remove bottle 1 from the ink jet printing apparatus, the bottle is merely un-screwed from the female threads 27 in reservoir lid 23. As the bottle is unscrewed, diaphragm 19 will maintain sealing engagement with the outer surface of piercing tube 35. As the membrane 19 moves clear of the piercing tube 35, the resilient membrane 19 will spring closed so as to effectively close slit 20 (or other opening punctured through the membrane), thus retaining ink remaining in the bottle 1. In essence, the resilient characteristics of the membrane 19 cause the slit 20 to act as a normally closed valve which upon removal of the piercing tube automatically and quickly closes. In this manner, a partly filled bottle may be removed from the piercing tube 35 substantially without spillage or leakage of ink, even though the bottle is in an inverted dispensing position. Further, because the slit 20 in membrane 19 resiliently closes, any remaining ink within the bottle is maintained in a closed container, thus preventing evaporation of solvents and preventing air borne contaminants from entering the ink bottle. Because of the open spider support structure 39 for piercing tube 35 and openings 41, in the event ink leaks from slit 20 as the bottle is removed, the ink will flow into reservoir and is not wasted.

In view of the above, it will be seen that the several objects and features of this invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

I claim:

1. An ink jet printing apparatus having an ink reservoir for receiving ink from a replaceable ink container, the latter having a supply of ink within said container, said ink reservoir having a reservoir housing and a ink well for containing a supply of ink, said reservoir supplying to an ink jet printer, wherein the improvement comprises:

a puncturable diaphragm carried on said container and closing said container;

a single hollow puncturing member carried by said ink reservoir housing engageable with said diaphragm upon said container being installed on said reservoir housing for piercing an opening through said diaphragm and for substantially sealingly engaging said puncturing member so as to substantially prevent the ink within said container from leaking past the exterior of said puncturing member, said puncturing member opening communication between said container and said ink reservoir thereby by permitting the ink to flow from said container into said ink reservoir, said diaphragm opening substantially closing upon said container being removed from said reservoir housing and upon said puncturing member being withdrawn from said diaphragm opening thereby to substantially re-close said diaphragm opening; and an air path through a wall of said reservoir in communication with the atmosphere and said reservoir, said air path having an opening into said reservoir spaced vertically above a bottom of said single puncturing member, so that with said container installed on said reservoir housing, the ink from within said container and atmospheric air from within said reservoir are exchanged via said puncturing member thereby to permit the ink to flow from said container into said reservoir and to permit air to enter said container so as to replace the ink flowing from said container.

2. An ink jet printing system as set forth in claim 1 wherein said puncturable diaphragm has an area of weakness engageable by said puncturing member so as to facilitate puncturing of said diaphragm.

3. An ink jet printing system as set forth in claim 2 where said area of weakness is a slit pre-formed in said diaphragm in which at least a portion of said slit does not fully extend through said diaphragm except upon being engaged by said puncturing member.

4. An ink jet printing system as set forth in claim 1 wherein said puncturing member extends downwardly into said reservoir and has a lower end, wherein said ink within said reservoir has a surface, and wherein upon said surface of the ink in said reservoir dropping below the lower end of said puncturing member, atmospheric air supplied to said reservoir via said air path and the ink from within said container are exchanged via said puncturing member.

5. An ink jet printing system as set forth in claim 1 wherein said container has a mouth and a cap secured to said mouth overlying said puncturable diaphragm, said cap having an opening therein for receiving said puncturing member as the puncturing member punctures through said diaphragm.

6. An ink jet printing system as set forth in claim 1 wherein said diaphragm has a surface energy and wherein said ink has a surface tension such that said surface energy of said diaphragm is less than the surface tension of said ink so that droplets of said ink are substantially prevented from leaking through a region of said diaphragm punctured by said puncturing member upon removal of said container from said puncturing member.

7. An ink jet printing system as set forth in claim 6 wherein the surface energy of said diaphragm is about 20 dyne/cm and the surface tension of said ink is about 35 dyne/cm.

8. An ink bottle for an ink jet printing system, said ink jet printing system comprising an ink reservoir for holding a supply of ink for said ink jet printing system, said reservoir including an upwardly projecting puncturing tube and an air path placing said reservoir in communication with the atmosphere, said air path having an inlet into said reservoir spaced vertically above a bottom of said puncturing tube, said bottle having a closed container body having a mouth at one end thereof, a puncturable diaphragm sealingly secured to said mouth closing the bottle, said diaphragm being of a sheet of resilient elastomeric material, a cap secured to said mouth and overlying at least a portion of said diaphragm, said cap having an opening therethrough exposing a portion of said diaphragm so as to be pierced by said upwardly projecting puncturing tube when the bottle is installed on said reservoir in inverted position such that the ink from within said bottle and atmospheric air within said reservoir are exchanged via said puncturing tube, said diaphragm re-closing upon said bottle being removed from said reservoir and upon said puncturing tube being withdrawn from said diaphragm.

9. An ink bottle as set forth in claim 8 wherein said reservoir has a recess with internal threads therein, and wherein said cap has external threads for threaded engagement with said internal threads such the upon threaded installation of said bottle into said reservoir recess, said puncturing tube pierces through said diaphragm and opens communication between said bottle and said reservoir for said ink and said atmospheric air exchange via said puncturing tube and maintains said bottle in substantially sealed relation with said reservoir.

10. An ink bottle as set forth in claim 8 wherein said diaphragm has a surface energy less than the surface tension of said ink so that droplets of ink are substantially prevented from leaking through the region of said diaphragm punctured by said puncturing tube upon removal of said container from said puncturing tube.

11. An ink supply system for an ink jet printing apparatus comprising an ink reservoir for receiving a supply of ink which is supplied to an ink jet printing head, said reservoir having a reservoir housing, a replaceable ink bottle for containing a supply of ink for said ink reservoir, said ink bottle having a puncturable diaphragm, a single hollow puncturing member carried by said ink reservoir housing, said single puncturing member being engageable with said diaphragm upon said ink bottle being moved toward said puncturing member so that said puncturing member punctures through said diaphragm and opens communication between the ink within said bottle and said reservoir, said single puncturing member being sealingly engageable with said diaphragm so as to substantially prevent the leakage of said ink between the exterior of said puncturing member and the region of said diaphragm in engagement with the exterior of said puncturing member, an air path in said reservoir between the outside atmosphere and said reservoir enabling the exchange of air and ink within said ink bottle via said single puncturing member, said air path having an inlet into said reservoir spaced vertically above a bottom of said single puncturing member said diaphragm being self-closing upon removal of said container from said reservoir housing and upon withdrawal of said single puncturing member from said diaphragm.

12. An ink supply system as set forth in claim 11 wherein said single puncturing member extends downwardly into said reservoir to a predetermined level such that upon an ink level within said reservoir falling below the predetermined level of the said puncturing member, said ink from within said container flows from said single puncturing member into said reservoir and said atmospheric air from within said reservoir enters said puncturing member to be exchanged with said ink within said bottle.

13. An ink supply as set forth in claim 11 wherein said diaphragm has a surface energy less than the surface tension of said ink so that droplets of ink will be substantially prevented from leaking through a region of said diaphragm punctured by said puncturing member upon removal of said container from said puncturing member.

14. An ink supply as set forth in claim 11 wherein said diaphragm has an area of weakness engageable by said puncturing member as said bottle is moved into an operating position so as to facilitate puncturing of said diaphragm.

15. An ink supply as set forth in claim 11 wherein said reservoir housing has an opening proximate said puncturing member such that ink leaking around said puncturing member flows into said reservoir with resultant air exchange.

16. An ink supply as set forth in claim 11 wherein said diaphragm is of sheet elastomeric material such that the opening punctured therethrough by said puncturing member substantially re-closes upon removal of said bottle from said puncturing member.

17. A method of supplying ink to an ink jet printing system, the ink jet printing system having a closed ink reservoir, a single vertical puncturing tube extending above the reservoir and providing communication between the interior of said reservoir and an ink bottle, said puncturing tube extending downwardly within said reservoir to a predetermined level, an air passageway extending from the atmosphere to said reservoir for venting said reservoir, said ink bottle having a puncturable diaphragm, wherein said method comprises the steps of:

orienting said ink bottle in an inverted position such that said diaphragm faces downwardly toward said single puncturing tube;

installing said bottle in said inverted position onto said puncturing tube such that said single puncturing tube pierces through said diaphragm and substantially seals said bottle with respect to said reservoir;

permitting atmospheric air to enter said reservoir by said air passageway;

upon the level of ink within said reservoir dropping below said predetermined level, causing said ink from within said bottle and said atmospheric air from within said reservoir to be exchanged via said single puncturing tube; and upon the removal of said bottle from said reservoir, closing said diaphragm upon the withdrawal of said single puncturing tube therefrom.

18. The method of claim 17 further comprising the steps of permitting the exchange of said ink and said atmospheric air via said puncturing tube upon the level of the ink within said reservoir dropping below the level of the lower end of said puncturing tube within said reservoir.

* * * * *

UNITED STATES PATENT AND TRADEMARK OFFICE

CERTIFICATE OF CORRECTION

PATENT NO : 6,079,823

DATED : June 27, 2000

INVENTOR(S) : Curtis R. Droege

It is certified that error appears in the above-identified patent and that said Letters Patent are hereby corrected as shown below:

Col. 6, Line 66

Insert the word ink after -- reservoir supplying

Signed and Sealed this

First Day of May, 2001

*Attest:*

Nicholas P. Godici

NICHOLAS P. GODICI

*Attesting Officer*

*Acting Director of the United States Patent and Trademark Office*